US005651692A

United States Patent [19]

Hatagishi

[11] Patent Number: 5,651,692

[45] Date of Patent: Jul. 29, 1997

[54] PRESS-CONNECTING CONNECTOR

[75] Inventor: Yuji Hatagishi, Shizuoka, Japan

[73] Assignee: Yazaki Corporation, Tokyo, Japan

[21] Appl. No.: 501,566

[22] Filed: Jul. 12, 1995

[30] Foreign Application Priority Data

Jul. 22, 1994 [JP] Japan ..... 6-171348

[51] Int. Cl.[6] ..... H01R 13/58

[52] U.S. Cl. ..... 439/459

[58] Field of Search ..... 439/459, 456, 439/460, 467

[56] References Cited

U.S. PATENT DOCUMENTS 3,336,565 8/1967 Crimmins ..... 439/459
5,066,243 11/1991 Neusslein et al. ..... 439/467

FOREIGN PATENT DOCUMENTS 4-136870 12/1992 Japan .
7176342 7/1995 Japan .

*Primary Examiner*—Gary F. Paumen
*Attorney, Agent, or Firm*—Sughrue, Mion, Zinn, Macpeak & Seas

[57] ABSTRACT

A connector body has a horizontal flat base plate, and vertical partition walls are formed on the flat base plate to form terminal receiving chambers each having an open top or bottom serving as a wire press-fitting opening. Tension-absorbing plates and are pivotally connected to a rear end of the flat base plate through respective hinge portions. The tension-absorbing plate is disposed generally flush with the flat base plate, and the tension-absorbing plate is pivotally movable into an upstanding position.

9 Claims, 4 Drawing Sheets

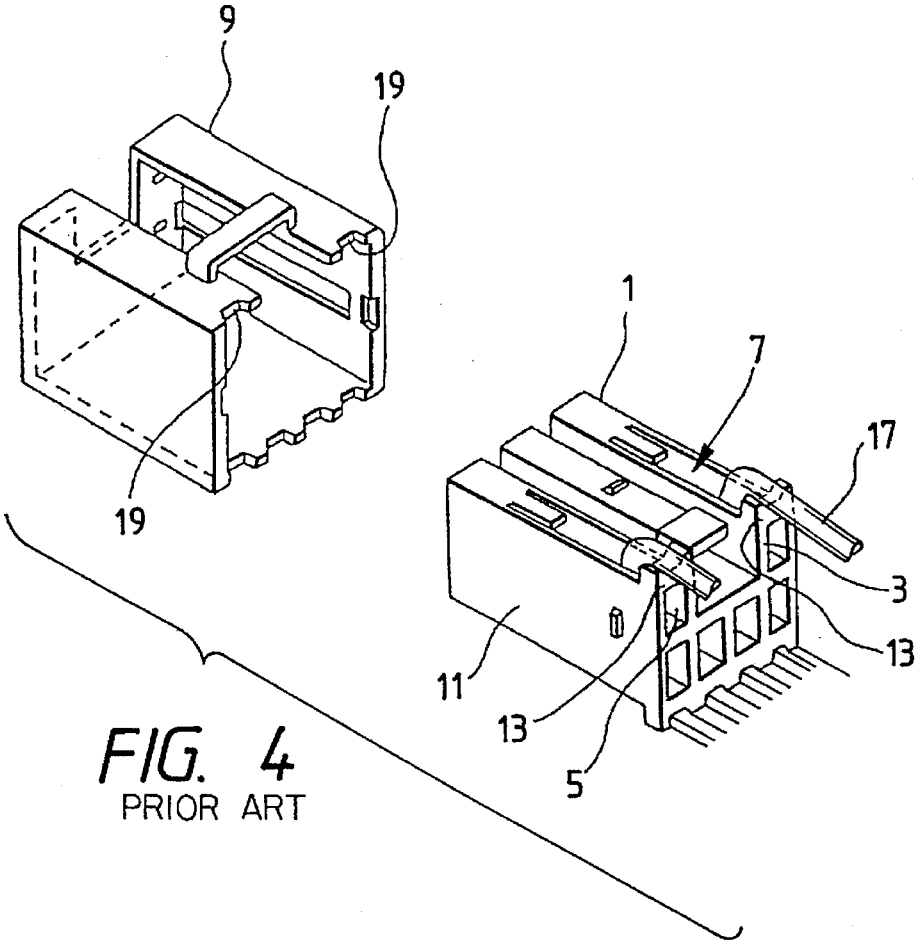
FIG. 4
PRIOR ART
FIG. 5
PRIOR ART
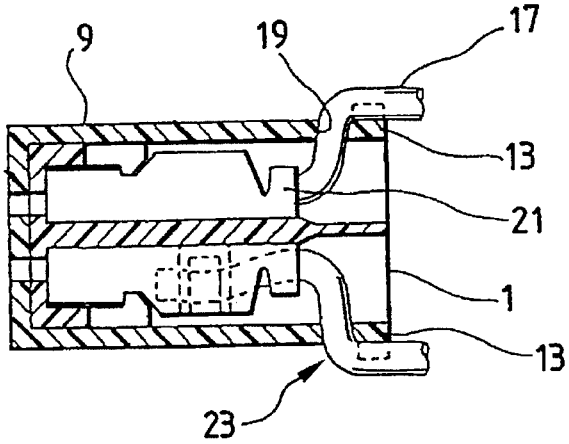

PRESS-CONNECTING CONNECTOR

BACKGROUND OF THE INVENTION

1. Field of the Invention

This invention relates to a press-connecting connector receiving press-connecting terminals, and more particularly to a strain relief structure for bearing tension acting on a wire.

2. Background

In a press-connecting connector, a sheathed wire is press-fitted into a press-connecting blade of a press-connecting terminal, so that a sheath of the wire is cut by the blade, thereby electrically connecting a conductor of the wire to the press-connecting terminal. However, although the press-connecting connector of such a press-connecting construction is excellent form the viewpoint of mass production, it suffers from a problem that the press-connected portion is weak against tension applied to the wire.

One example of so-called strain relief structure of such a press-connecting connector for bearing tension applied to a wire will now be described with reference to FIGS. 4 and 5. FIG. 4 is an exploded, perspective view of the conventional press-connecting connector, and FIG. 5 is a cross-sectional view of the conventional press-connecting connector having a cover fitted thereon.

Terminal receiving chambers 5 are formed at upper and lower portions of a housing 1 of a cubic shape, and are spaced from one another by partition walls 3. Each upper terminal receiving chamber 5 is open as at 7 to an upper surface of the housing 1 whereas each lower terminal receiving chamber 5 is similarly open to a lower surface of the housing 1. The cover 9 with an open rear end can be fitted onto the outer periphery of the housing 1 from the front side of the housing 1. A bridge portion 13 extends between each side wall 11 of the housing 1 and its adjoining partition wall 3, and also a bridge portion 13 is extends between any two adjacent ones of the partition walls 13. Wire holder portions 19 each in the form of a recess are formed at the rear end of the cover 9, and correspond to the bridge portions 13, respectively. The wire holder portion 19 cooperates with the associated bridge portion 13 to hold a wire 17, extending from the terminal receiving chamber 5 through the opening 7, therebetween (see FIG. 5).

In the conventional press-connecting connector of the above construction, the wire 17, connected to a press-connecting terminal 21 received in the terminal receiving chamber 5, is led out through the opening 17, and then the cover 9 is fitted on the housing 1, so that the wire 17 is held between the wire holder portion 19, formed at the rear end of the cover 9, and the bridge portion 13. The thus held wire 17 is extended rearwardly from the housing 1, so that the wire 17 is bent as at 23. This bent portion 23 offers a resistance to tension applied to the wire 17, thereby reducing the effect of the tension on that portion of the press-connecting terminal 21 to which the wire is press-connected.

Generally, in a press-connecting connector, the wire 17 is press-fitted into the press-connecting terminal 21 received in the terminal receiving chamber 5, thereby making an electrical connection therebetween.

However, in the press-connecting connector having the bridge portions 13, the wire 17 is grasped by a chuck 25 disposed rearwardly of the bridge portion 13, and then is press-fitted into the press-connecting terminal 21 (received in the terminal receiving chamber 5) through the opening 7, as shown in FIG. 6. Therefore, the front end portion of the wire 17 is bent or turned about a point P of contact between the wire 17 and the bridge portion 13, so that the wire 17 is drawn rearwardly about the point P. As a result, as shown in FIG. 7, a press-connecting blade 29 of the press-connecting terminal 21 may be deformed during the press-fitting of the wire 17 into this blade 29, and also a dimension C of extending of the front end portion of the wire 17 from the press-connecting blade 29 may be varied, which may result in incomplete press-connection.

SUMMARY OF THE INVENTION

The present invention has been made in view of the above problems, and an object of the invention is to provide a press-connecting connector with a strain relief structure in which a wire can be press-fitted into a press-connecting terminal without being bent, thereby enhancing the efficiency of the press-connecting operation, and also preventing incomplete press-connection.

The above object has been achieved by a press-connecting connector of the invention characterized in that a connector body has a horizontal flat base plate; vertical partition walls are formed on the flat base plate to form terminal receiving chambers each having an open top serving as a wire press-fitting opening; and a tension-absorbing plate is pivotally connected to a rear end of the flat base plate through a hinge portion, the tension-absorbing plate being disposed generally flush with the flat base plate, and the tension-absorbing plate being pivotally movable into an upstanding position.

During the time when a wire is press-fitted into each of the terminal receiving chambers through the corresponding opening, the tension-absorbing plate is held generally flush with the flat base plate, and therefore the wire will not interfere with those parts constituting a strain relief structure, and hence will not be deformed. Then, after the wire is connected to the terminal, the tension-absorbing plate is moved into the upstanding position, and is held there, so that the wire is bent by this tension-absorbing plate, and tension applied to the wire is borne by this bent portion of the wire.

BRIEF DESCRIPTION OF THE DRAWINGS

FIG. 4 is an exploded, perspective view of a conventional press-connecting connector;

FIG. 5 is a cross-sectional view of the conventional press-connecting connector having a cover fitted thereon;

DETAILED DESCRIPTION OF THE PREFERRED EMBODIMENTS

Figure 1:
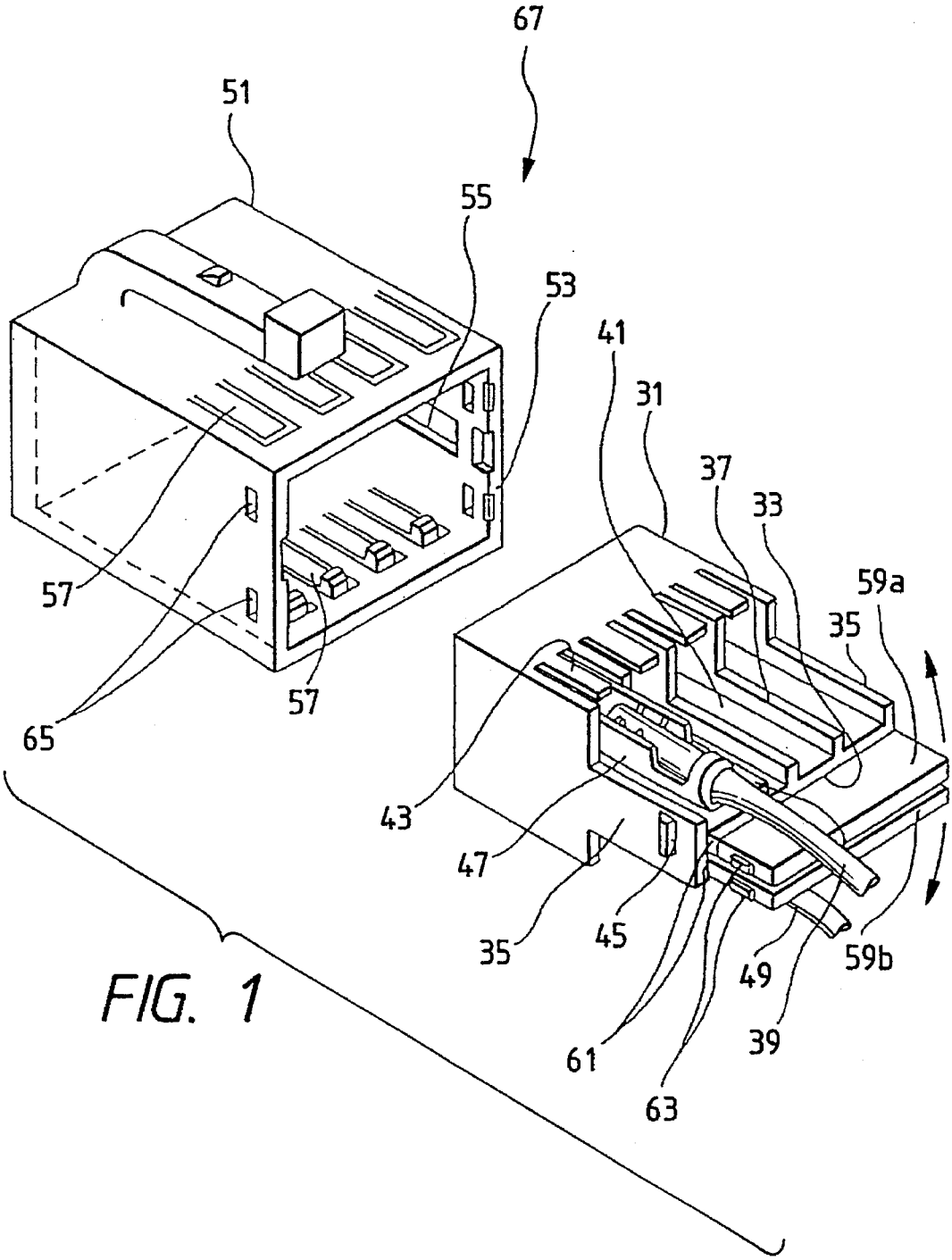
FIG. 1 is an exploded, perspective view of a press-connecting connector of the present invention.

A preferred embodiment of a press-connecting connector of the present invention will now be described in detail with reference to the drawings. FIG. 1 is an exploded, perspective view of the press-connecting connector of the invention, and FIG. 2 is a cross-sectional view of the press-connecting connector in its assembled condition.

A connector body 31 has a flat base plate 33 extending horizontally centrally of the height of the connector body 31, and the connector body 31 is divided by this flat base plate 33 into an upper portion and a lower portion. Opposite vertical side plates 35 are provided on opposite side edges of the flat base plate 33, respectively. A plurality of upstanding partition walls 37 are formed on each of upper and lower surfaces of the flat base plate 33. A space between the opposite side plates 35 is divided by the partition walls 37 into a plurality of terminal receiving chambers 39. Each of the terminal receiving chambers 39 on the upper surface of the flat base plate 33 has an open top or opening 41 for wire press-fitting purposes whereas each of the terminal receiving chambers 39 on the lower surface of the flat base plate 33 has an open bottom or opening 41 for wire press-fitting purposes. A plurality of elastic retaining piece portions (lances) 43 are formed on each of upper and lower plates of the connector body 31. Projections 45, serving as retaining member for retaining an outer cover (described later), are formed on the outer surfaces of the opposite side plates 35, respectively.

Figure 2:
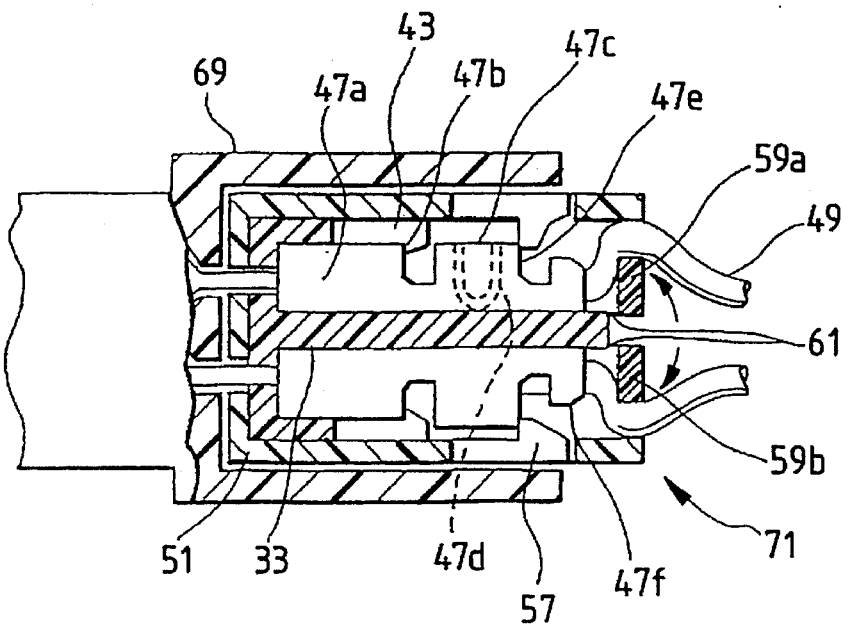
FIG. 2 is a cross-sectional view of the press-connecting connector of FIG. 1 in its assembled condition.

As shown in FIG. 2, a press-connecting terminal 47 to be received in the terminal receiving chamber 39 includes an electrical contact portion 47*a* at its front end portion, and a rear end of the electrical contact portion 47*a* serves as a first retaining portion 47*b* engageable with the lance 43. Provided rearwardly of the first retaining portion 47*b* is a press-connecting portion 47*c* having a press-connecting blade 47*d* which cuts a sheath of a wire 49 to be electrically connected to a conductor of the wire 49. A rear end of the press-connecting portion 47*c* serves as a second retaining portion 47*e* engageable with a lance 57 formed on the outer cover (described later). Formed rearwardly of the second retaining portion 47*e* is a wire holding portion 47*f* adapted to be wound on the wire 49 to fix the press-connecting terminal 47 to the wire 49.

The box-shaped outer cover 51 with an open rear end is removably fitted on the outer periphery of the connector body 31, and recesses 55 are formed respectively in opposite side walls 53 of the outer cover 51, and are engaged with the projections 45, respectively. Namely, the outer cover 51 is fitted on the connector body 31, so that the recesses 55 are retainingly engaged with the projections 45, respectively. A plurality of lances 57 are formed on each of upper and lower plates of the outer cover 51, and when the outer cover 51 is fitted on the connector body 31, each of the lances 57 is retainingly engaged with the second retaining portion 47*e* of the associated press-connecting terminal 47. Therefore, the press-connecting terminal 47 is retained in a double manner by the lance 43 on the connector body 31 and the lance 57 on the outer cover 51.

Two tension-absorbing plates 59*a* and 59*b* are connected to the rear end of the flat base plate 33 through respective thin hinge portions 61. When the tension-absorbing plates 59*a* and 59*b* are disposed horizontally, these plates 59*a* and 59*b* lie generally flush with the upper and lower surfaces of the flat base plate 33, respectively, so that each of the two plates 59*a* and 59*b* forms, together with the corresponding surface of the flat base plate 33, a continuous flat surface. The tension-absorbing plates 59*a* and 59*b* can be pivotally moved upwardly and downwardly, respectively, into a vertical or upstanding condition through the respective hinge portions 61. Upstanding-purpose projections (fixing means) 63 are formed on opposite side edges of each of the tension-absorbing plates 59*a* and 59*b*, respectively. Fixing holes (fixing means) 65 are formed through the opposite side walls of the outer cover 51 at rear end portions thereof. The outer cover 51 is fitted on the connector body 31, and in this condition when the tension-absorbing plates 59*a* and 59*b* are moved into their respective upstanding positions, the upstanding-purpose projections 63 are engaged in the fixing holes 65, respectively. In the upstanding condition of the tension-absorbing plates 59*a* and 59*b*, a space is formed between the inner surface of the rear open end of the outer cover 51 and the distal end of each of the tension-absorbing plates 59*a* and 59*b*. The wire 49 can be led out through this space.

The press-connecting connector 67 comprises, as main parts, the connector body 31, the flat base plate 33, the outer cover 51, the tension-absorbing plates 59*a* and 59*b*, the hinge portions 61, the upstanding-purpose projections 63, and the fixing holes 65.

Next, the procedure for assembling the press-connecting connector 67 will now be described.

For assembling the press-connecting connector 67, the press-connecting terminals 47 are first received in the terminal receiving chambers 39, respectively, and the first retaining portion 47*b* of the press-connecting terminal 47 is retained by the lance 43.

After the press-connecting terminal 47 is thus received in the terminal receiving chamber 39, the wire 49 is press-fitted into the terminal 47 through the opening 41 in the upper side or the lower side of the connector body 31, so that the press-connecting blade 47d cuts the sheath of the wire 49 to be electrically connected to the conductor of the wire 49.

At this time, the tension-absorbing plates 59*a* and 59*b* are disposed horizontally to lie generally flush with the upper and lower surfaces of the flat base plate 33, respectively.

After the wire 49 is connected to the press-connecting terminal 47, the outer cover 51 is fitted on the connector body 31.

Then, the tension-absorbing plates 59*a* and 59*b* are pivotally moved upwardly and downwardly, respectively, so that the upstanding-purpose projections 63 are engaged respectively in the fixing holes 65 in the outer cover 51, thereby fixing the tension-absorbing plates 59*a* and 59*b* in their respective upstanding positions, and also each wire 49 is led out through the space between the inner surface of the rear open end of the outer cover 51 and the tension-absorbing plate 59*a*, 59*b*, thus completing the assembling of the press-connecting connector 67.

A mating connector 69 is fitted onto the thus assembled press-connecting connector 67 from the front side of the connector 67, so that the press-connecting terminals 47 are electrically connected to respective mating terminals. In the press-connecting connector 67 of this construction, the tension-absorbing plate 59*a*, 59*b* lies generally flush with the flat base plate 33 during the time when the wire is press-fitted into the terminal through the opening 41, and therefore the wire 49 would not interfere with a bridge portion 13 (see FIG. 5) as provided in the conventional strain relief structure, and hence will not be deformed.

After the wire is connected to the terminal, the tension-absorbing plates 59*a* and 59*b* are fixed in their respective upstanding conditions, so that the wire 49 is bent as at 71 by the tension-absorbing plate 59*a*, 59*b*, and this bent portion 71 bears tension applied to the wire 49.

Figure 7:
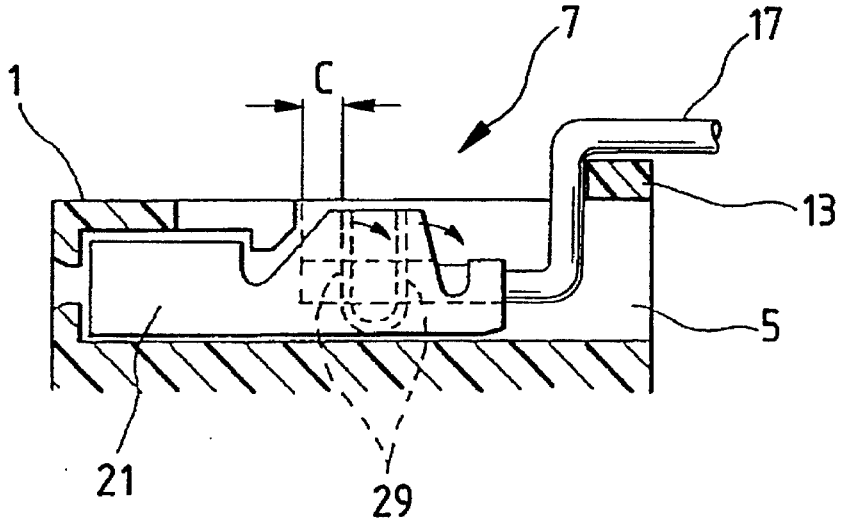
FIG. 7 PRIOR ART
FIG. 7 is a view showing a condition of the conventional press-connecting connector in which a wire is connected to a terminal.

In the above press-connecting connector 67, the tension-absorbing plates 59*a* and 59 are pivotally movable through the respective hinge portions 61, and therefore the tension-absorbing plate 59*a*, 59*b* will not interfere with the wire 49 during the press-fitting of the wire 49 into the terminal, and therefore the wire 49 can be press-fitted into the terminal without being bent, and besides it is not necessary to insert the tension-absorbing plates between the wires after the press-fitting of the wires. As a result, in the press-connecting connector with the strain relief structure, the efficiency of the press-connecting operation is enhanced, and the dimension C (see FIG. 7) of extending of the wire front end is not varied, thus preventing incomplete press-connection.

Figure 3:
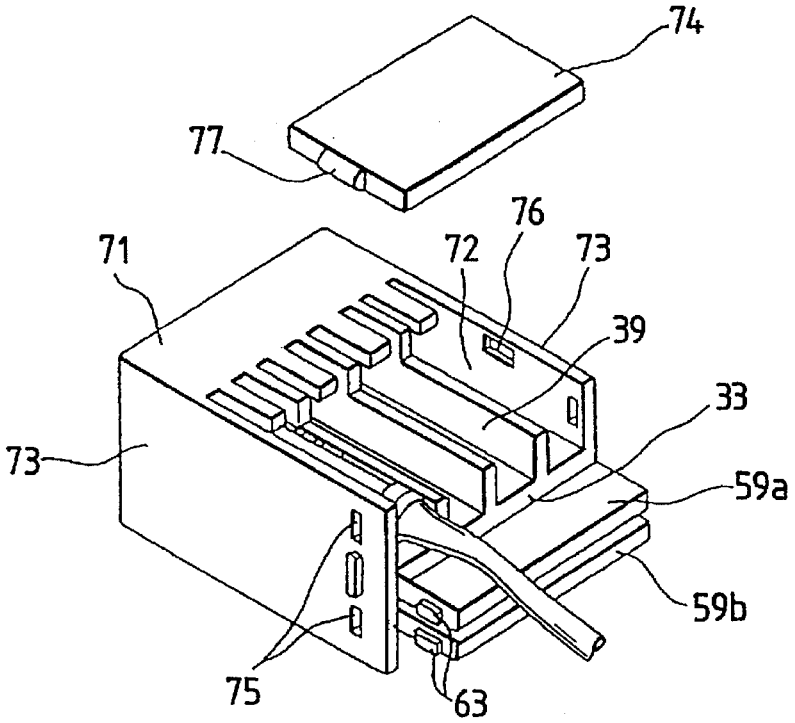
FIG. 3 is a perspective view of a modified press-connecting connector of the invention.
Figure 6:
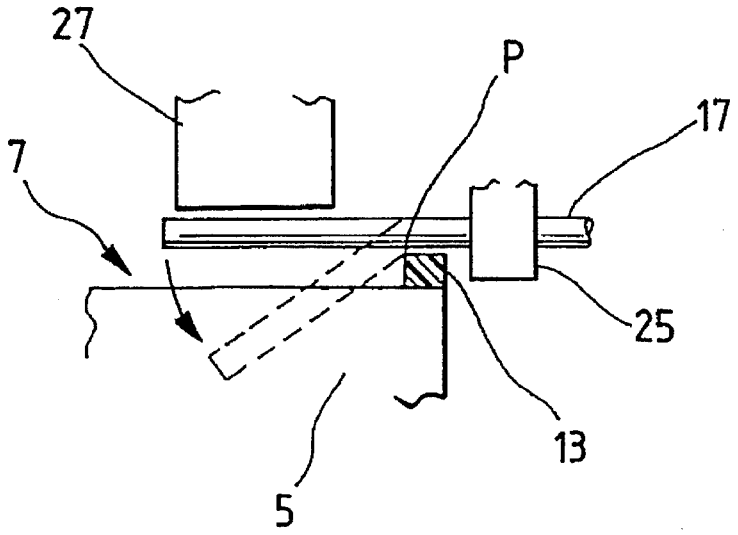
FIG. 6 PRIOR ART
FIG. 6 is a view showing a manner of press-fitting a wire in the conventional press-connecting connector.

A modified form of the above press-connecting connector 67 will now be described. FIG. 3 is a perspective view of a modified press-connecting connector of the invention.

In the above press-connecting connector 67, the fixing holes 65 are formed in the outer cover 51, and the upstanding-purpose projections 63 on the tension-absorbing plates 59*a* and 59*b* are engaged respectively in the fixing holes 65 in the upstanding condition of the tension-absorbing plates 59*a* and 59*b*. However, such fixing holes 65 may be formed in other part than the outer cover 51.

For example, in the modified connector shown in FIG. 3, opposite side plates 73, provided respectively on opposite side edges of a flat base plate 33, have a rectangular shape, and fixing holes 75 for engagement respectively with the upstanding-purpose projections 63 are formed in the side plates 73. With this construction, the type of press-connecting connector without the outer cover 51 can achieve a function as described above.

Closure plates 74 are removably attached to a connector body 71 to respectively close wire press-fitting openings 72 formed respectively in upper and lower surfaces of a connector body 71. Retaining projections 77, formed respectively on opposite side edges of the closure plate 74, are engaged respectively in recesses 76 formed respectively in the side plates 73, thereby fixing the closure plate 74 to the connector body 71 against displacement. Namely, in this press-connecting connector without the outer cover 51, the closure plate 74 prevents press-connecting terminals in respective terminal receiving chambers 39 from being exposed, and also prevents dust and the like from intruding into the terminal receiving chambers 39.

As described above in detail, in the press-connecting connector of the present invention, the connector body has the horizontal flat base plate, and the tension-absorbing plates are pivotally connected to the rear end of the flat base plate through the respective hinge portions. Each tension-absorbing plate is disposed generally flush with the flat base plate, and the tension-absorbing plate is pivotally movable into the upstanding position. With this construction, during the press-fitting of the wire, the wire will not interfere with the tension-absorbing plate, and therefore the wire can be press-fitted into the terminal without being bent. As a result, in the press-connecting connector with the strain relief structure, the efficiency of the wire press-connecting operation is enhanced, and also incomplete press-connection can be prevented.

What is claimed is:

1. A connector, comprising:

a housing having a terminal receiving chamber provided therein for receiving a terminal including an electrical contact portion and a wire connecting portion for connecting a wire, said terminal receiving chamber being defined by partition walls on opposite sides thereof, a substantially flat base plate and an outer wall;

a first retaining member, for retaining said electrical contact portion, formed on said outer wall; and a tension-absorbing plate, for bearing tension applied to said wire, having a hinge portion, said tension-absorbing plate being pivotally connected to a rear end of said flat base plate through said hinge portion, wherein said tension-absorbing plate is initially disposed generally flush with said flat base plate, and said tension-absorbing plate is subsequently pivotally movable into an upstanding position to engage the wire.

2. The connector of claim 1, further comprising:

a pair of vertical side plates formed on opposite side edges of said flat base plate, respectively; and fixing means, for holding said tension-absorbing plate in said upstanding position, provided on said vertical side plates and opposite side edges of said tension-absorbing plate.

3. The connector of claim 2, wherein said fixing means includes upstanding projections and fixing holes.

4. The connector of claim 3, wherein said upstanding projections are formed on opposite side edges of said tension-absorbing plate, and said fixing holes are formed through said vertical side plates.

5. The connector of claim 2, wherein a closure plate for preventing entrance of dust into said terminal receiving chamber is removably attached to said housing.

6. The connector of claim 1, further comprising:

an outer cover removably fitted on said housing; and fixing means, for holding said tension-absorbing plate in said upstanding position, provided on said outer cover and opposite side edges of said tension-absorbing plate.

7. The connector of claim 6, wherein said fixing means includes upstanding projections and fixing holes.

8. The connector of claim 7, wherein said upstanding projections are formed on opposite side edges of said tension-absorbing plate, and said fixing holes are formed through opposite side walls of said outer cover.

9. The connector of claim 6, wherein said outer cover has a second retaining member for retaining a rear end of said wire connecting portion.

* * * * *